United States Patent [19]

Pritchard

[11] 3,983,859

[45] Oct. 5, 1976

[54] WATER SPRINKLER SYSTEM INTERNAL COMBUSTION ENGINE CONTROL

[76] Inventor: Arnold J. Pritchard, Rte. 1, Carnegie, Okla. 73015

[22] Filed: Oct. 29, 1975

[21] Appl. No.: 626,885

[52] U.S. Cl. ..... 123/198 DC; 123/198 D; 123/41.15

[51] Int. Cl.[2] ..... F02B 77/08

[58] Field of Search... 123/198 D, 198 DC, 198 DB, 123/198 R, 41.15

[56] References Cited

UNITED STATES PATENTS

| | | | |
|---|---|---|---|
| 2,131,264 | 9/1938 | Benjamin | 123/198 DC X |
| 2,603,690 | 7/1952 | Moody | 123/198 DC X |
| 2,712,813 | 7/1955 | Thomas | 123/198 DC X |
| 2,771,068 | 11/1956 | Jettinghoff | 123/198 DC X |
| 3,138,144 | 6/1964 | Armbrust | 123/198 D X |
| 3,388,695 | 6/1968 | O'Donnell | 123/198 D |
| 3,533,391 | 10/1970 | Lockmuller | 123/198 DB |
| 3,645,245 | 2/1972 | Hammond et al. | 123/198 DB X |
| 3,832,982 | 9/1974 | Guehr | 123/198 D X |
| 3,881,461 | 5/1975 | Filip | 123/198 D |

*Primary Examiner*—Charles J. Myhre
*Assistant Examiner*—Ira S. Lazarus
*Attorney, Agent, or Firm*—Robert K. Rhea

[57] ABSTRACT

The invention comprises a plurality of fluid actuated members for interrupting the ignition circuit and stopping the operation of an internal combustion engine in the event of a malfunction of the engine or components driven thereby. A tank containing air under pressure is connected with an electrical current conducting master switch interposed in the engine ignition circuit and comprising a hollow housing divided by a diaphragm which, by the tank air pressure, normally maintains the master switch closed. Loss of the air pressure opens the master switch. Other similar diaphragm type fluid pressure operated members respectively connected with and responsive to radiator coolant level and temperature, engine oil pressure and sprinkler system water pressure vents the pressurized air from the tank in the event of a malfunction.

4 Claims, 6 Drawing Figures

WATER SPRINKLER SYSTEM INTERNAL COMBUSTION ENGINE CONTROL

BACKGROUND OF THE INVENTION

1. Field of the Invention

The present invention relates to stationary internal combustion engines and more particularly to a control for stopping the engine in the event of malfunction.

One use of stationary combustion engines has been for operating a water well pump and supplying water pressure to a crop sprinkler system. Since it is impractical for the engine to be attended at all times during its operation some means for stopping the engine is necessary in the event of a malfunction of the engine or other components.

2. Description of the Prior Art

Controls for stopping the operation of a stationary engine are well known, such as an electrical current operated timer or limiting the quantity of fuel available, so that the engine is stopped at a predetermined time. Prior art electrically operated engine controls generally have a drawback, namely, that in the event of a short circuit in the engine control unit the control unit is rendered inoperative and possibly ignites a fire, resulting in considerable damage to the engine. Other proposals for stopping engine operation have been the use of vacuum operated switches interposed in the ignition circuit which interrupts the circuit in the event that the intake manifold vacuum varies from a predetermined value. This type of control similarly has the disadvantage of not responding to engine malfunction, such as loss of water contained by the radiator or failure of an engine driven water well pump.

This invention overcomes the above disadvantages by providing pressure operated valve members connected with a source of air under pressure and the respective component to be monitored so that, in the event of a malfunction of any one component, loss of air pressure normally maintaining a master switch closed opens the switch and interrupts current to the engine ignition.

SUMMARY OF THE INVENTION

A normally closed pressure responsive diaphragm operated master switch is interposed in the battery to ignition circuit of an internal combustion engine. A tank, containing air under greater than atmospheric pressure, supplies pressure to maintain the master switch closed. In the event a loss of air pressure from the tank, the contacts of the pressure switch are biased open by spring force thus interrupting current to the engine ignition. Other pressure responsive diaphragm-type valve members, connected with the air tank, are respectively connected with the engine oil pressure line and well pump water pressure line which, upon malfunction of either pressure source, releases the air from the air tank thus resulting in opening the master switch. A water level float chamber, connected with the air tank and radiator, is connected with another pressure responsive diaphragm operated valve member for bleeding air from the air tank in the event excess pressure is generated in the radiator. The float short circuits the engine ignition in the event water in the radiator falls below a predetermined level.

The principal object of this invention is to provide a pneumatic control for a stationary internal combustion engine which stops the engine in the event of engine malfunction or malfunction in associated components.

DESCRIPTION OF THE PREFERRED EMBODIMENTS

Figure 1:
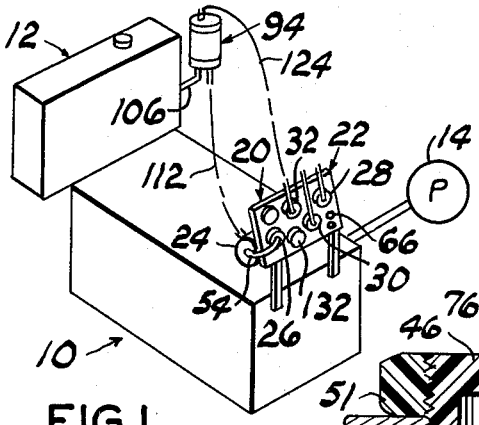
FIG. 1 is a diagrammatic perspective view of an internal combustion engine connected with a water well pump and illustrating the panel mounted controls supported by the engine.

Like characters of reference designate like parts in those figures of the drawings in which they occur.

Figure 2:
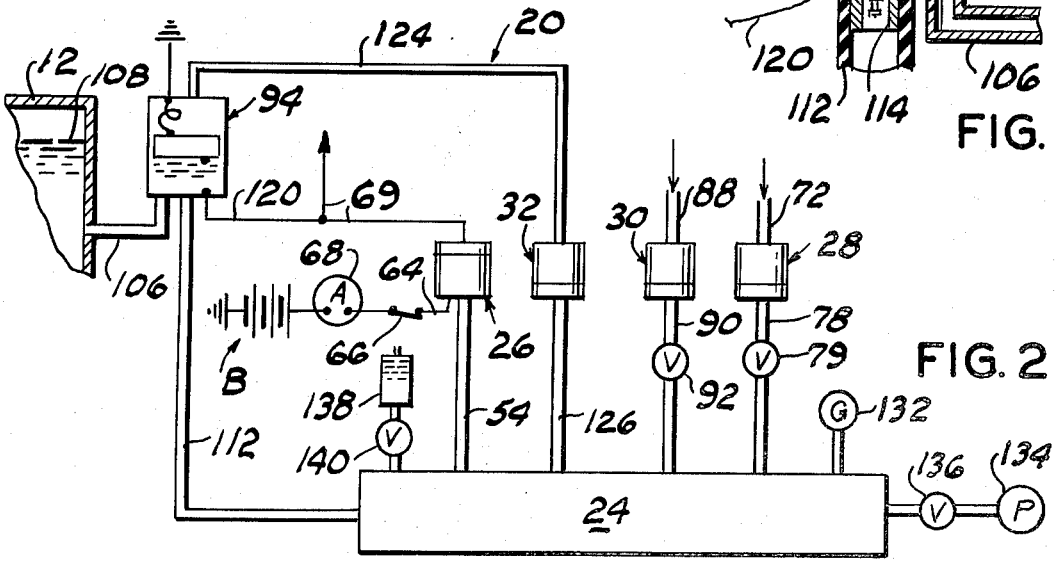
FIG. 2 is a schematic of the engine controls.

In the drawings:

Referring to FIGS. 1 and 2, the reference numeral 10 indicates a conventional internal combustion engine cooled by a radiator 12 and having an ignition circuit, not shown. The engine 10 is also provided with a conventional oil pump, not shown. The engine 10 drives a water well pump 14 for supplying water pressure to a crop sprinkler system, not shown.

The reference numeral 20 represents the engine control system, as a whole, comprising a panel 22 connected with or supported by the engine 10 in a convenient position. The control panel 22 supports an airtight reservoir or tank 24 containing air under greater than atmospheric pressure, a master switch 26, oil responsive unit 28, water well pump water pressure responsive unit 30 and a radiator coolant level and pressure responsive unit 32.

Figure 3:
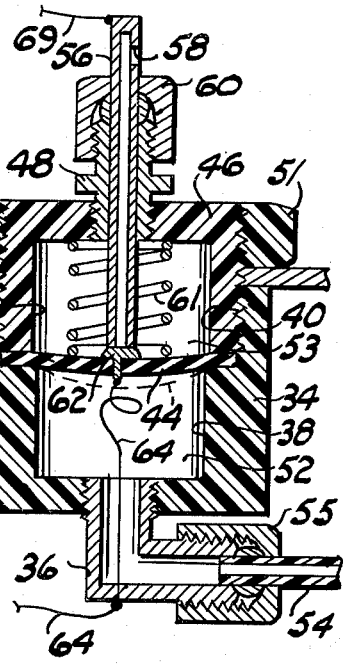
FIG. 3 is a longitudinal cross sectional view of the engine master control switch.

Referring also to FIG. 3, the master switch 26 comprises a generally cylindrical hollow housing formed of electrical nonconductive material, such as plastic. The housing comprises a cup-shaped body member 34 which is coaxially drilled and threaded to receive a fitting 36 communicating with the socket formed by its inner wall 38. The inner wall is counterbored and threaded, as at 40, to form an annular shoulder 42 facing away from the fitting 36 which supports a diaphragm 44. The threaded counterbore 40 receives a body plug member 46 which is centrally bored and threaded to receive a fitting 48 and counterbored, as at 50, complemental with the diameter of the inner wall surface 38, to complete the hollow interior of the housing. The length of the plug member 46 is greater than the depth of the counterbore 40. A nut 51, threadedly engaging the end portion of the plug member 46, opposite the shoulder 42, secures the master switch to the control panel 22 within a cooperating aperture formed therein. The diaphragm 44 divides the master switch to form two chambers 52 and 53. The air tank 24 is connected with the fitting 36 by an electrical nonconductive flexible tube 54, formed of rubber or plastic material, and a nut 55 for communication with the chamber 52.

The fitting 48 coaxially receives a tube 56 having one end open and disposed adjacent the diaphragm 44. The other end of the tube 56 is closed and provided with a wall port 58 providing atmospheric communication with the chamber 53. A nut and ferrule 60 surrounds the tube 56 to permit longitudinal adjustment of the tube with respect to the fitting 48 and the position of the diaphragm 44, as hereinafter explained.

An expansion spring 61 loosely surrounds the tube 56 between the diaphragm 44 and the inner end of the plug counterbore 50. The spring 61 biases the diaphragm 44 away from the open end of the tube for the reasons presently explained.

The diaphragm is centrally provided with a metallic insert T-shaped plug 62 having a head portion normally contacting the open end of the tube 56. A wire 64 is connected at one end with the stem of the diaphragm plug and with the fitting 36, intermediate its ends, and extended through the fitting 36 to a battery B in series with a normally closed on-off switch 66 and ammeter 68. A wire 69 is connected with the closed end of the tube 56 and connected at its other end to the coil, not shown, of the engine ignition circuit. The wires 64 and 69, in combination with the diaphragm plug 62 and master switch tube 56, form a part of the ignition current path. The diaphragm plug and open end of tube 56 form normally closed electrical contacts permitting the ignition circuit to be interrupted or broken by movement of the diaphragm 44 away from the open end of the tube 56.

The diaphragm is preferably prestretched and normally under the force of the spring 61 would be disposed in the position shown by dotted lines wherein electrical contact between the diaphragm plug 62 and tube 56 would be broken. In normal operation of the engine, air pressure in the tank 24, such as two or three atmospheres, normally maintains the diaphragm 44 in the solid line position of FIG. 3 to maintain contact between the diaphragm plug 62 and tube 56 so that current is supplied to the engine coil as long as the switch 66 remains closed. The spring expansion force, diaphragm response and electrical contacts of the master switch may be adjusted, as desired, by loosening the fitting nut 60 and longitudinally moving the tube 56. The tube port 58 admits and releases air to and from the chamber 53 in response to movement of the diaphragm 44 toward and away from the tube 56. Obviously, a rod, not shown, may be used in place of the tube 56 and a vent to atmosphere, for the chamber 53, formed through the plug member 46 to accomplish the same function. In the event of loss of air pressure within the tank 24 or a decrease in pressure below a predetermined value of the spring 61, the spring force moves the diaphragm 44 toward the fitting 36 thus opening the master switch and interrupting current to the engine.

Figure 4:
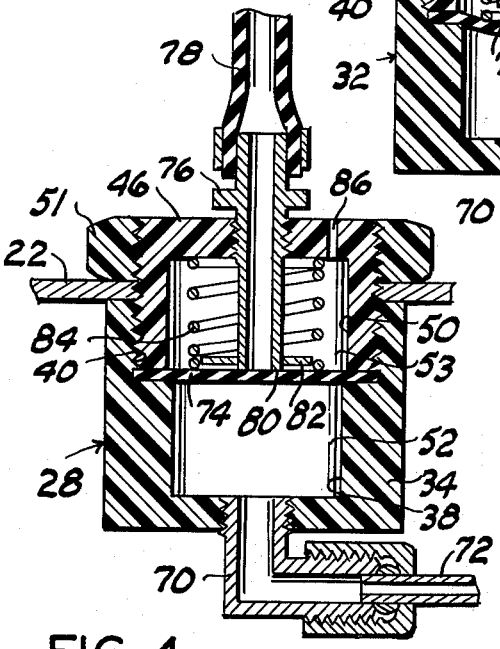
FIG. 4 is a view similar to FIG. 3 illustrating an engine control unit responsive to water or oil pressure.

Referring also to FIG. 4, the control unit 28 comprises an identical and similarly numbered housing. The housing body 34 is provided with a fitting 70, similar to the fitting 36, connected with a tube 72 communicating with the oil pressure system, not shown, of the engine 10. The housing is similarly divided by a diaphragm 74. The plug 46 of the housing is provided with a centrally bored fitting 76 connected with one end of a hose 78 having a normally open valve 79 interposed therein. The other end of the hose is connected to and communicates with the tank 24. The other end of the fitting 76 is tubular and has its open end 80 disposed adjacent the position of the diaphragm 74. Adjacent its open end 80, the fitting 76 is provided with a flange 82 for supporting the diaphragm 74 against oil pressure applied thereto from the line 72. A spring 84 similarly surrounds the fitting 76 and extends between the inner limit of the housing plug counterbore 50 and diaphragm 74. A vent or port 86, formed in the housing plug 46, provides communication between the chamber 53 and the atmosphere for the reasons presently apparent.

Structurally the well pump water pressure engine control unit 30 is identical to the description of the oil pressure control unit 28 having its fitting 70 connected with a water pump pressure supply line 88 (FIG. 2) and the fitting 76 similarly connected to the air tank 24 by a tube or hose 90 through a normally open control valve 92.

Operation of the oil and water pressure control units 28 and 30 is identical in that oil or water pressure through the tubes 72 or 88 maintains the diaphragm 74 against the open end 80 of the fitting 76 so that air pressure in the tank 24 is maintained. In the event of loss of oil pressure by engine malfunction or loss of well pump water pressure, the force of the spring 84 moves the diaphragm 74 away from the open end 80 of the fitting 76 thus exhausting the air pressure in the tank 24 through the fitting, chamber 53 and vent 86 which results in opening the master switch, as explained hereinabove.

Figure 6:
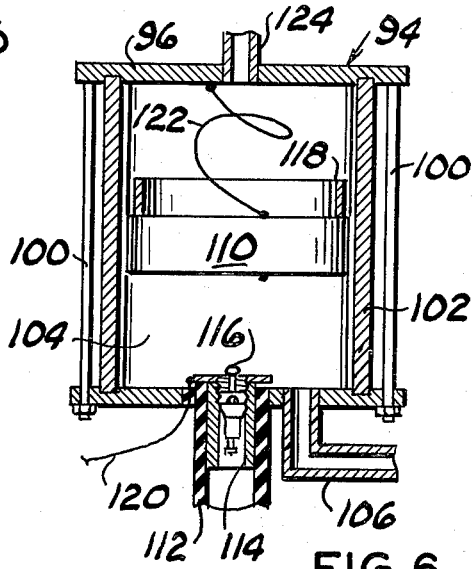

Referring also to FIG. 6, a radiator water level control unit, comprises a vertically disposed generally cylindrical member 94, having upper and lower plates 96 and 98, joined in spaced-apart relation by rods 100. The distance between the plates 96 and 98 is spanned by an open end transparent wall sleeve 102, forming a chamber 104 communicating with the core of the radiator 12 by a tube 106 connected with the lower plate 98 and the radiator below the level of the radiator water or coolant 108. The plate 98 is disposed below the normal upper limit of the radiator coolant 108 a selected distance. The chamber 104 contains a float 110 to visually indicate the level of the fluid within the radiator 12. The lower plate 98 is similarly connected with the air pressure tank 24 by an electrical nonconducting tube 112. The end of the tube 112, projecting through the plate 98, is provided with a metallic sleeve 114 which contains an air valve core having a depressible stem 116 for opening the valve. The air valve core normally prevents escape of air from the tank 24 into or through the float chamber 104. The air valve core stem 116 projects above the upper limit of the metallic sleeve 114 so that in the event the level of the radiator coolant 108 decreases below a predetermined critical level the float 110 descending by gravity contacts and depresses the valve core stem 116 thus exhausting the air from the tank 24 which opens the master switch 26 and kills the engine, as explained hereinabove.

A metallic ring 118 or a suitable weight may overlie the float 110 to selectively increase its mass and insure depression of the core 116 when the coolant level is low. The metallic sleeve 114 includes an annular flange portion which is connected with one end of a wire 120 connected at its other end with the ignition circuit wire 69. The float 110 is connected by a wire 122 to the upper flange 96 which, through the rods 100, completes a circuit to ground at the low voltage side of the engine ignition coil, not shown, from the ignition wires 69 and 120 through the float 110, when it contacts the valve core stem 116 and/or the flange of the metallic sleeve 114. Grounding the ignition wire 69 in this manner prevents a hazardous short circuit. The upper flange 96, of the float control 94, is connected by a tube 124 to the radiator coolant pressure control unit 32.

Figure 5:
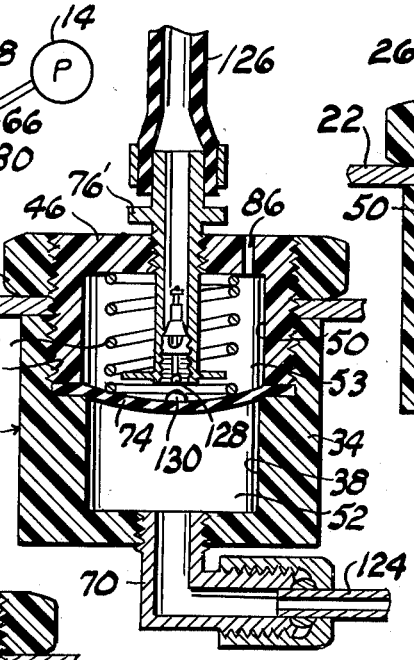
FIG. 5 is a view similar to FIG. 4 illustrating an engine control unit responsive to radiator coolant pressure; and, FIG. 6 is a longitudinal cross sectional view of the engine control unit responsive to radiator water level.

As shown in FIG. 5, the radiator coolant pressure control unit 32 comprises an identical similarly numbered housing, fittings, diaphragm and spring, as described for FIG. 4, with the exception the fitting 76' is connected with the air tank 24 by a hose 126 not having a valve in the hose. Another difference being that the open end of the fitting 76', within the housing chamber 53, is internally threaded for receiving an air valve core having a depressible valve stem 128 which normally maintains air pressure within the air tank 24. In this embodiment the force of the spring 84 is calibrated to a pressure responsive rating less than the pounds psi rating of the radiator pressure cap but sufficient to maintain the diaphragm 74 in spaced relation with respect to the air valve core and its stem 128.

A small lug or protrusion 130 is centrally secured to the diaphragm 74 on its surface disposed toward the fitting 76' and positioned to contact and depress the valve core stem 128 in the event radiator vapor pressure exceeds a predetermined value which, if this occurs, opens the air valve by the plug 130 depressing the valve stem 128. Such action exhausts the air from the air tank 24 causing the master switch 26 to open.

The air tank 24 is preferably provided with a pressure gauge 132 and is filled with air under pressure by a pump 134 connected with the tank through a valve 136. A timed release of the air pressure within the tank 24 may be employed, such as a container 138, containing a quantity of liquid so that air passing therethrough is indicated by bubbles. The container 138 is connected to the air tank 24 through a needle valve 140, or the like, which may be opened to permit minute escape of air through the liquid container 138 wherein, with a little practice by trial and error, the operator may learn to adjust the valve 140 to bleed off air from the tank 24 at a desired rate for maintaining sufficient pressure in the master switch 26 and operation of the engine 10 a predetermined length of time.

When initially starting the engine the desired air pressure, if not present, is generated in the tank 24 by the pump 134 or any suitable means. With the valves 79, 92 and 140 closed the engine is started, assuming, of course, that the coolant level within the radiator 12 is normal. After the engine 10 is started and engine oil pressure has reached its operating level the valve 79 is opened. When water pressure, generated by the water pump 14, is operating the sprinkler system the valve 92 is opened. Thereafter the engine operates until stopped by the master switch 26 in response to loss of air pressure in the tank 24 through any one of the pressure responsive units, radiator coolant level being low or by a timed release of the tank air pressure.

Obviously the invention is susceptible to changes or alterations without defeating its practicability. Therefore, I do not wish to be confined to the preferred embodiment shown in the drawings and described herein.

I claim:

1. An internal combustion engine having an ignition control circuit, comprising:

a normally closed master switch interposed in the ignition circuit, said master switch including a first hollow housing, a first diaphragm dividing the housing to form a first airtight chamber and a chamber open to the atmosphere, switch means including a pair of contacts within said housing and normally maintained closed by said first diaphragm, and spring means biasing said pair of contacts apart;

a tank containing air under greater than atmospheric pressure, said tank being connected with the airtight chamber for biasing said diaphragm toward a switch contact closed position; and, a fluid operated unit including normally closed valve means connected with said tank for exhausting the air therein in response to malfunction of an engine driven component.

2. The ignition control according to claim 1 in which said fluid operated unit includes:

a second hollow housing;

a second diaphragm dividing the second housing to form a second airtight chamber and a chamber vented to the atmosphere;

an open end tube having one open end disposed within the vented chamber and normally closed by said second diaphragm, the other end of said tube being connected with said tank, other spring means biasing said second diaphragm away from the first named open end of said tube; and, tubing connecting fluid under pressure generated by said engine with the second airtight chamber.

3. The ignition control according to claim 2 in which said other spring means normally maintains said second diaphragm in spaced relation with respect to the first named open end of said tube and further including:

a first valve core having a depressible stem for opening the valve disposed within the first named open end of said tube; and, means supported by said second diaphragm for depressing said valve stem and opening said first valve in response to a fluid pressure increase beyond a predetermined value within the airtight chamber.

4. The ignition control according to claim 1 in which said engine is provided with a coolant containing radiator and said fluid operated unit includes:

a float chamber forming housing having a depending end communicating with said radiator;

a float within the float chamber;

an open end tube having one end disposed within the depending end of the float chamber and having its other end connected with said tank; and, a valve core having a depressible valve stem for opening the valve core disposed within the first named open end of said tube, whereby said float depresses said valve stem when the coolant level in said radiator falls below a predetermined limit.

* * * * *